US006579063B2

(12) United States Patent
Stairs et al.

(10) Patent No.: US 6,579,063 B2
(45) Date of Patent: Jun. 17, 2003

(54) HIGH EFFICIENCY, INFLOW-ADAPTED, AXIAL-FLOW FAN

(75) Inventors: Robert W. Stairs, Westwood, MA (US); David S. Greeley, Lexington, MA (US)

(73) Assignee: Robert Bosch Corporation, Waltham, MA (US)

( * ) Notice: Subject to any disclaimer, the term of this patent is extended or adjusted under 35 U.S.C. 154(b) by 0 days.

(21) Appl. No.: 10/007,745

(22) Filed: Nov. 8, 2001

(65) Prior Publication Data

US 2003/0026699 A1 Feb. 6, 2003

Related U.S. Application Data

(60) Provisional application No. 60/246,852, filed on Nov. 8, 2000.

(51) Int. Cl.[7] ..... F04D 29/38

(52) U.S. Cl. ..... 416/169 A; 416/189; 416/243

(58) Field of Search ..... 416/169 A, 189, 416/192, 223 R, 238, 243, DIG. 2

(56) References Cited

U.S. PATENT DOCUMENTS

| | | | | |
|---|---|---|---|---|
| 4,063,852 | A | 12/1977 | O'Connor | 416/228 |
| 4,358,245 | A | 11/1982 | Gray | 416/189 |
| 4,569,632 | A | 2/1986 | Gray, III | 416/189 |
| 4,930,990 | A | 6/1990 | Brackett | 416/223 R |
| 5,244,347 | A | 9/1993 | Gallivan et al. | 416/189 |
| 5,297,931 | A | 3/1994 | Yapp et al. | 415/208.1 |
| 5,730,583 | A | 3/1998 | Alizadeh | 416/189 |
| 5,769,607 | A | 6/1998 | Neely et al. | 416/189 |

FOREIGN PATENT DOCUMENTS

| | | | |
|---|---|---|---|
| JP | 408049698 | A | 2/1996 |

OTHER PUBLICATIONS

Copy of International Search Report dated May 9, 2002.

*Primary Examiner*—Edward K. Look
*Assistant Examiner*—Dwayne J. White
(74) *Attorney, Agent, or Firm*—Fish & Richardson P.C.

(57) ABSTRACT

An efficient axial flow fan comprises a central hub, a plurality of blades, and a band, and is designed to operate in a shroud and induce flow through one or more heat exchangers—in an automotive engine cooling assembly, for example. The fan blades have a radial distribution of pitch ratio that provides high efficiency and low noise in the non-uniform flow field created by the heat exchanger(s) and shroud. The blade has either no sweep, or is swept backward (i.e. opposite the direction of rotation) in the region between the radial location r/R=0.70 and the tip (r/R=1.00). The blade pitch ratio increases from the radial location r/R=0.85 to a radial location between r/R=0.90 and r/R=0.975, and then decreases to the blade tip.

15 Claims, 14 Drawing Sheets

HIGH EFFICIENCY, INFLOW-ADAPTED, AXIAL-FLOW FAN

Under 35 USC §119(e)(1), this application claims the benefit of prior U.S. provisional application No. 60/246,852, filed Nov. 8, 2000.

TECHNICAL FIELD

The invention generally relates to fans, particularly those used to move air through radiators and heat exchangers, for example, in vehicle engine-cooling assemblies.

BACKGROUND

Typical automotive cooling assemblies include a fan, an electric motor, and a shroud, with a radiator/condenser (heat exchanger), which is often positioned upstream of the fan. The fan comprises a centrally located hub driven by a rotating shaft, a plurality of blades, and a radially outer ring or band. Each blade is attached by its root to the hub and extends in a substantially radial direction to its tip, where it is attached to the band. Furthermore, each blade is "pitched" at an angle to the plane of fan rotation to generate an axial airflow through the cooling assembly as the fan rotates. The shroud has a plenum which directs the flow of air from the heat exchanger(s) to the fan and which surrounds the fan at the rotating band with minimum clearances (consistent with manufacturing tolerances) so as to minimize recirculating flow. It is also known to place the heat exchangers on the downstream (high pressure) side of the fan, or on both the upstream and downstream side of the fan.

Like most air-moving devices, the axial flow fan used in this assembly is designed primarily to satisfy two criteria. First, it must operate efficiently, delivering a large flow of air against the resistance of the heat exchanger and the vehicle engine compartment while absorbing a minimum amount of mechanical/electrical power. Second, it should operate while producing as little noise and vibration as possible. Other criteria are also considered. For example, the fan must be able structurally to withstand the aerodynamic and centrifugal loads experienced during operation. An additional issue faced by the designer is that of available space. The cooling assembly must operate in the confines of the vehicle engine compartment, typically with severe constraints on shroud and fan dimensions.

To satisfy these criteria, the designer must optimize several design parameters. These include fan diameter (typically constrained by available space), rotational speed (also usually constrained), hub diameter, the number of blades, as well as various details of blade shape. Fan blades are known to have airfoil-type sections with pitch, chord length, camber, and thickness chosen to suit specific applications, and to be either purely radial in planform, or swept (skewed) back or forward. Furthermore, the blades may be symmetrically or non-symmetrically spaced about the hub.

SUMMARY

By controlling blade pitch as a function of radius, we have discovered a fan blade design for a banded fan which is adapted to the flow environment created by a heat exchanger and shroud, and which hence provides greater efficiency and reduced noise. Blade pitch directly affects the pumping capacity of a fan. It must be selected based on the rotational speed of the fan, the air flow rate through the fan, and the desired pressure rise to be generated by the fan. Of particular concern is the precise radial variation of pitch, which depends on the blade skew and also on the radial distribution of airflow through the fan.

Skewing the blades of a fan (often done to reduce noise) changes its aerodynamic performance and hence blade pitch must be adjusted to compensate. Specifically, a blade that is skewed backward relative to the direction of rotation generally should have a reduced pitch angle to produce the same lift at a given operating condition as an unskewed blade that is in all other respects the same. Conversely, a forwardly skewed fan blade generally should have increased pitch to provide equal performance. The invention takes these factors into account.

In addition the invention accounts for radial variation in air inflow velocity. In the case of the assembly shown in FIG. 1, the incoming air passes through the radiator and is then forced by the shroud plenum to converge rapidly from the large cross-sectional flow area of the radiator to the smaller flow area of the fan opening in the shroud. This results in a flow field at the fan that is highly non-uniform radially.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
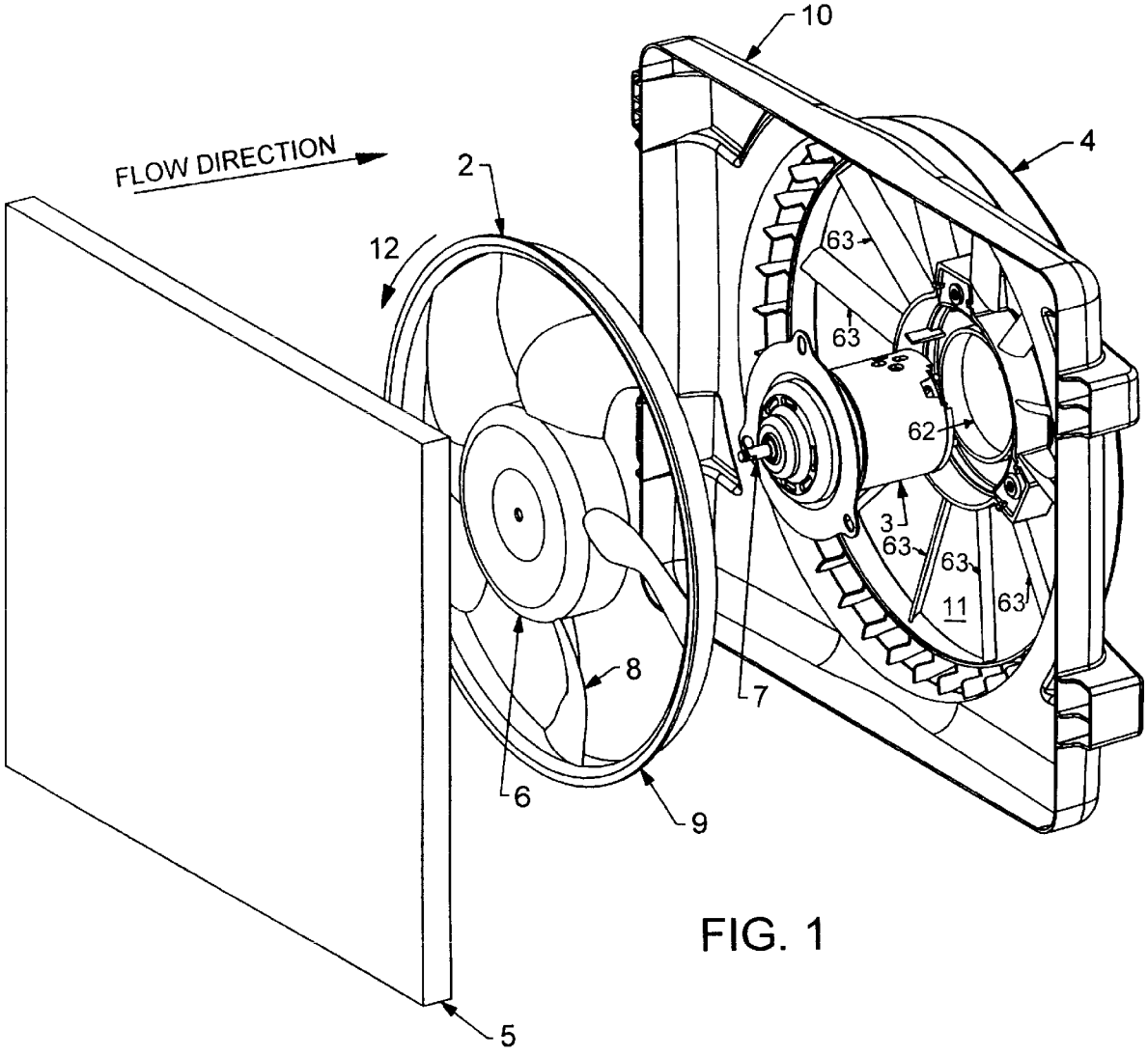
FIG. 1 is an exploded perspective view of a fan, electric motor, and shroud. A heat exchanger is diagramatically shown upstream of the fan.
Figure 12:
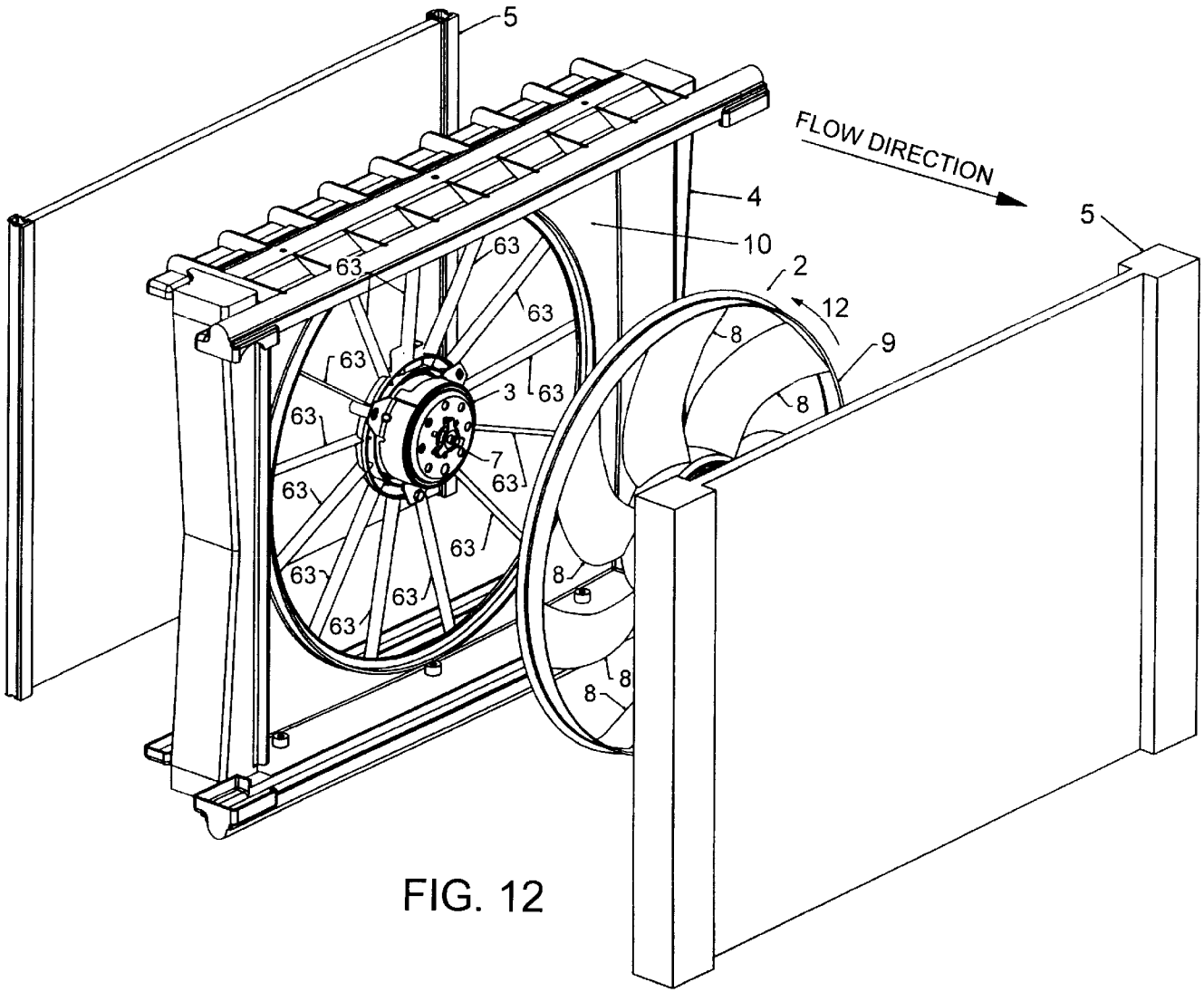
FIG. 12 is an exploded perspective view of an airflow assembly with fan, electric motor, shroud, and heat exchangers both upstream and downstream of the fan.
Figure 13A:
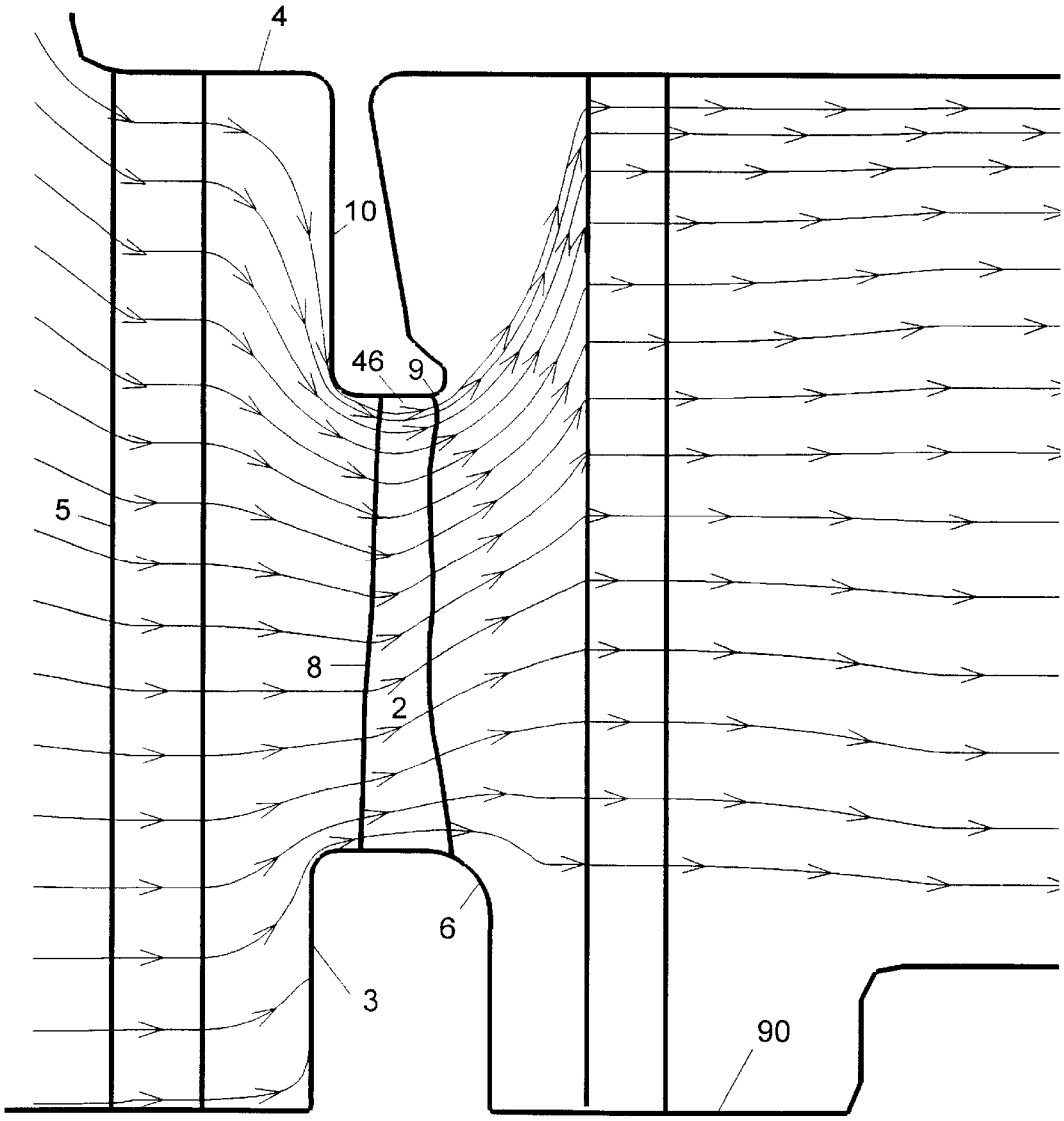
FIG. 13A shows a simplified cross-section of an airflow assembly with a shroud, motor, fan, including hub, and a heat exchanger on both the upstream and downstream side of the fan. Stream traces show the flow of air through the assembly.
Figure 13B:
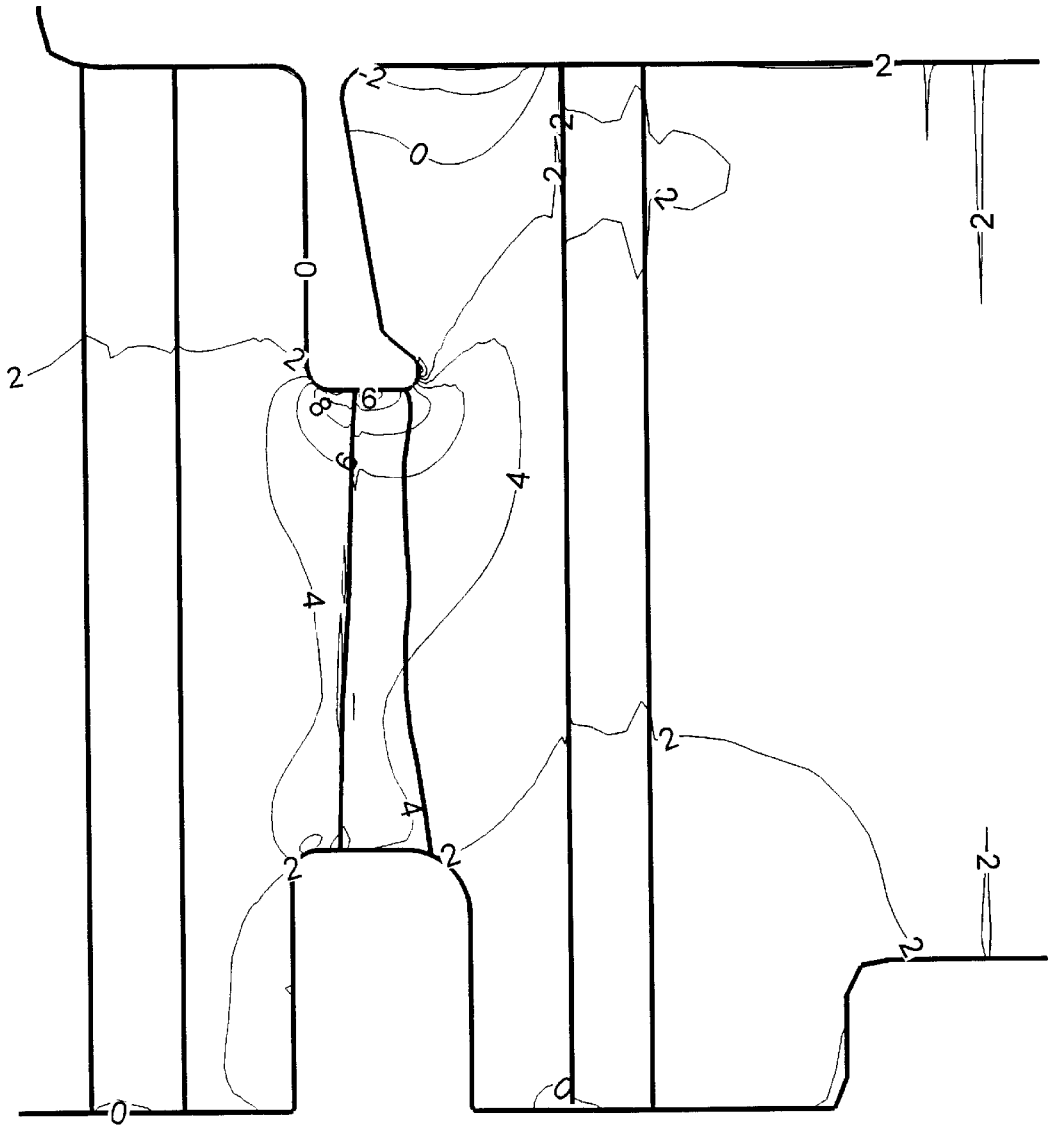
FIG. 13B shows contours of the velocity component parallel to the axis of rotation, demonstrating the concentration of flow that occurs near the tip of the fan blades.

FIG. 1 shows the general elements of a cooling assembly, including a fan, a motor, a shroud, and a heat exchanger upstream of the fan. Similarly, FIG. 12 shows the general elements of a cooling assembly in which the heat exchanger is downstream of the fan.

Figure 2:
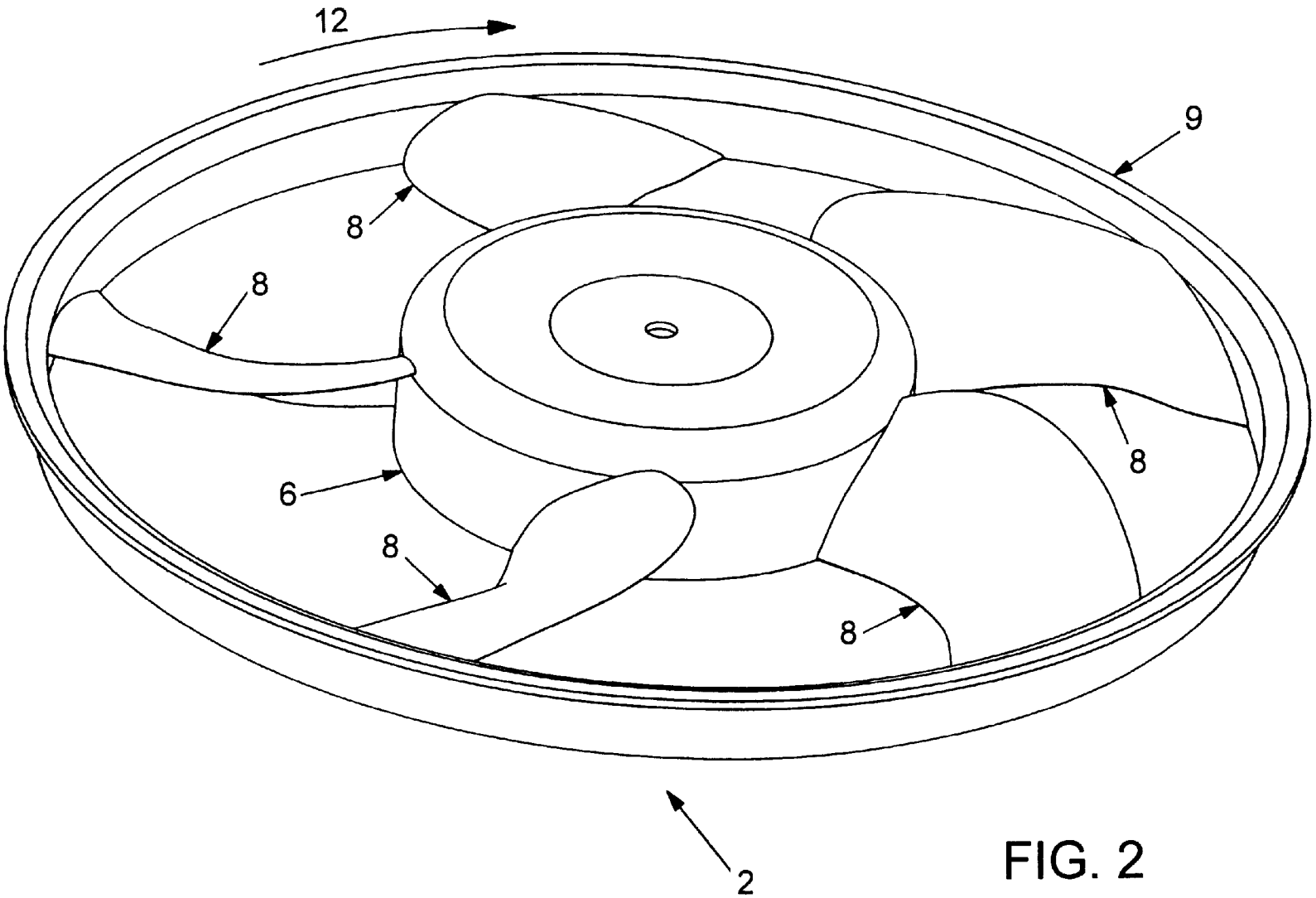
FIG. 2 is a perspective view of a fan with the characteristics described in the present invention.
Figure 3:
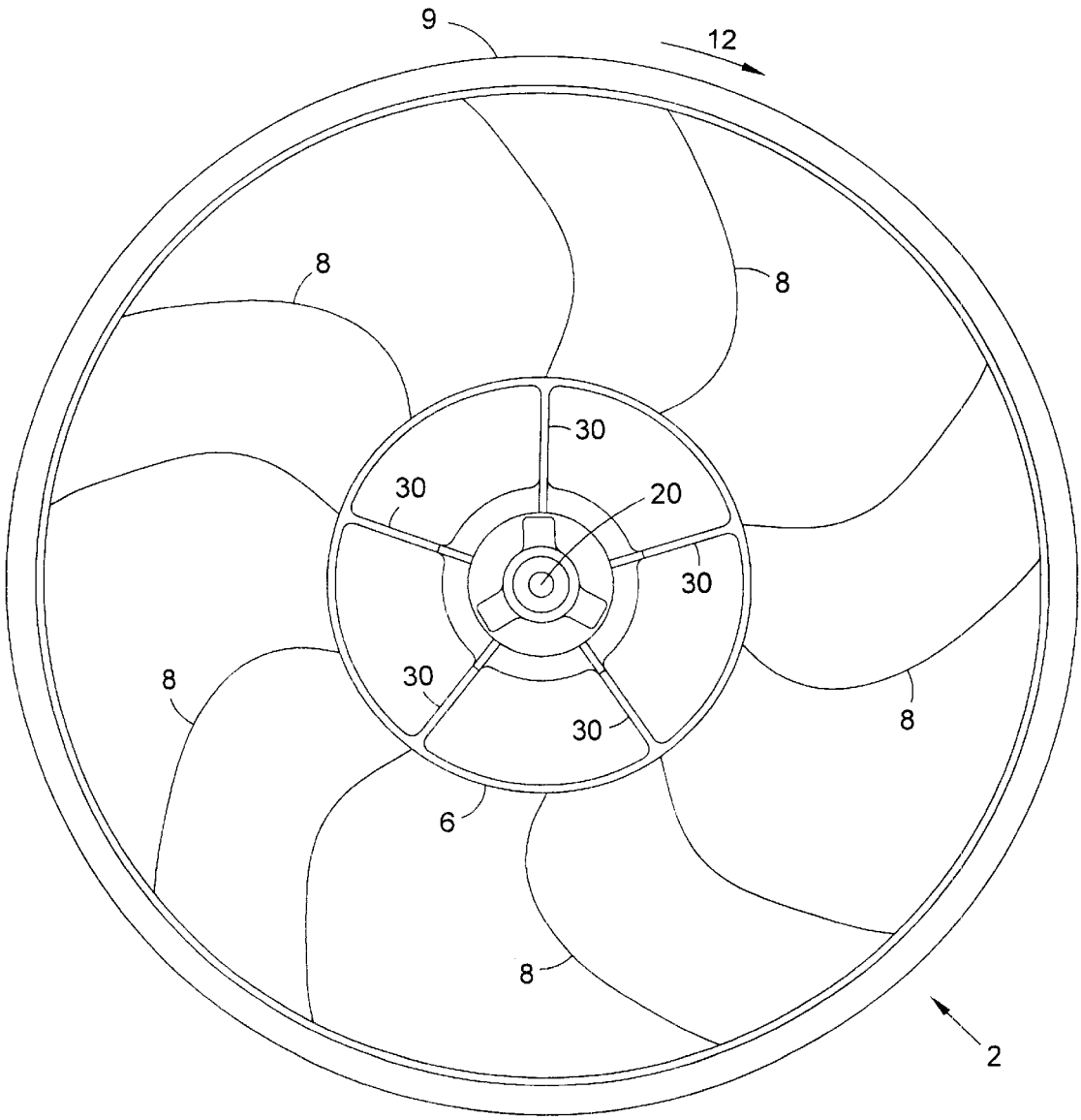
FIG. 3 shows a plan view of the fan from the exhaust (downstream) side.

FIGS. 2–3 show a fan 2 of the present invention. Designed to induce the flow of air through an automotive heat exchanger, the fan has a centrally located hub 6 and a plurality of blades 8 extending radially outward to an outer band 9. The fan is made from molded plastic.

The hub is generally cylindrical and has a smooth face at one end. An opening 20 in the center of the face allows insertion of a motor-driven shaft for rotation around the fan central axis 90 (shown in FIG. 4). The opposite end of the hub is hollow to accommodate a motor (not shown) and includes several ribs 30 for added strength.

Figure 4:
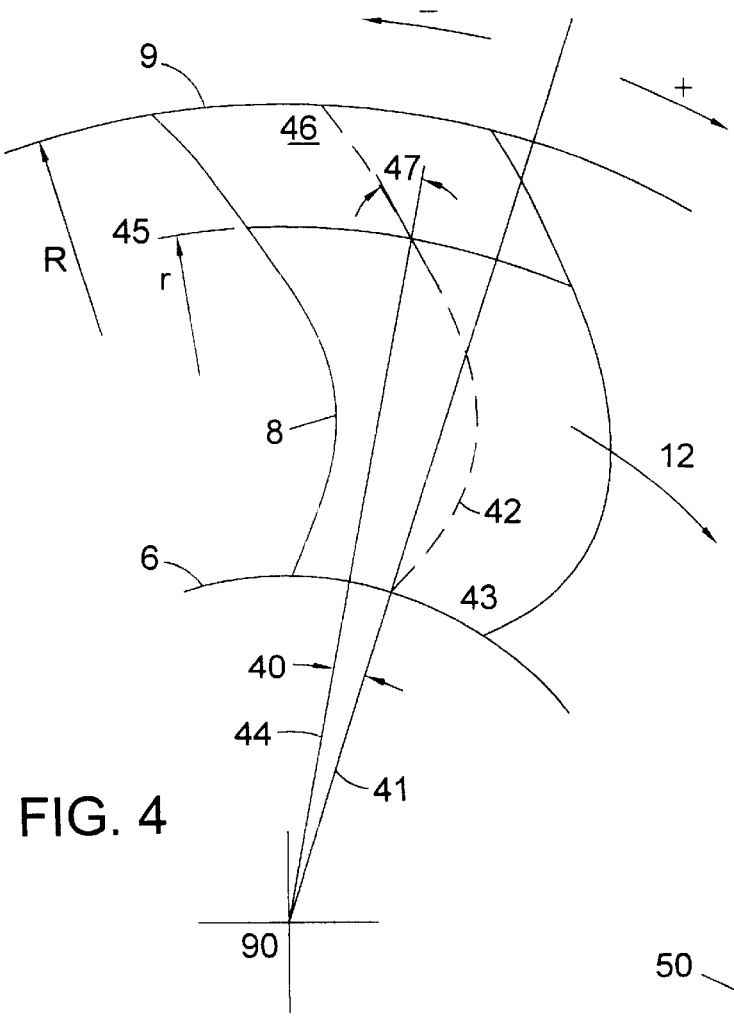
FIG. 4 illustrates blade skew angle, defined as the angle between a radial line intersecting the blade mid-chord line at a given radius and a radial line intersecting the blade mid-chord line at the blade root. Blade sweep angle is also illustrated.

In the embodiment shown, the blades 8 are swept backwards, or opposite the direction of rotation 12, in the tip region. Blade skew and blade sweep are defined as follows. Skew angle 40 is the angle between a radial reference line 41 intersecting the blade mid-chord line 42 at the blade root and a second radial line passing through the planform mid-chord at a given radius 45 (FIG. 4). A positive skew angle 40 indicates skew in the direction of rotation. Zero skew angle 40 or a skew angle 40 that is constant with radius indicates a blade with straight planform (radial blade). Blade sweep angle 47 is the angle between a radial line passing through the planform mid-chord line at a given radius and a line tangent to the axial projection of the mid-chord at the same given radius (FIG. 4). Hence, following this convention, backward sweep means locally decreasing skew angle. Compared to a fan with radial blades, a fan with blades that are swept backwards in the tip region will generally produce less airborne noise and will also occupy less axial space, since the blades will have lower pitch in the tip region.

Figure 5:
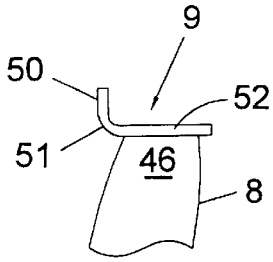
FIG. 5 shows a typical fan-band geometry in cross-section.

Outer band 9 (FIG. 5) adds structural strength to the fan 2 by supporting the blades 8 at their tips 46, and improves aerodynamic efficiency by reducing the amount of air that recirculates from the high pressure side of the blades to the low pressure side around the tips of the blades. Where the tips of the blades are attached to the band, the band must be almost cylindrical to allow manufacture by molding. In front, or upstream, of the blades, the band consists of a radial, or nearly radial, portion (lip) 50 and a bell mouth radius 51, which serves as a transition between the cylindrical 52 and radial portions 50 of the band. Aerodynamically, the bell mouth 51 acts as a nozzle to direct the flow into the fan and is provided with as large a radius as possible to ensure smooth flow through the fan blade row. However, space constraints generally limit the radius to a length less than 10–15 mm.

Figure 6:
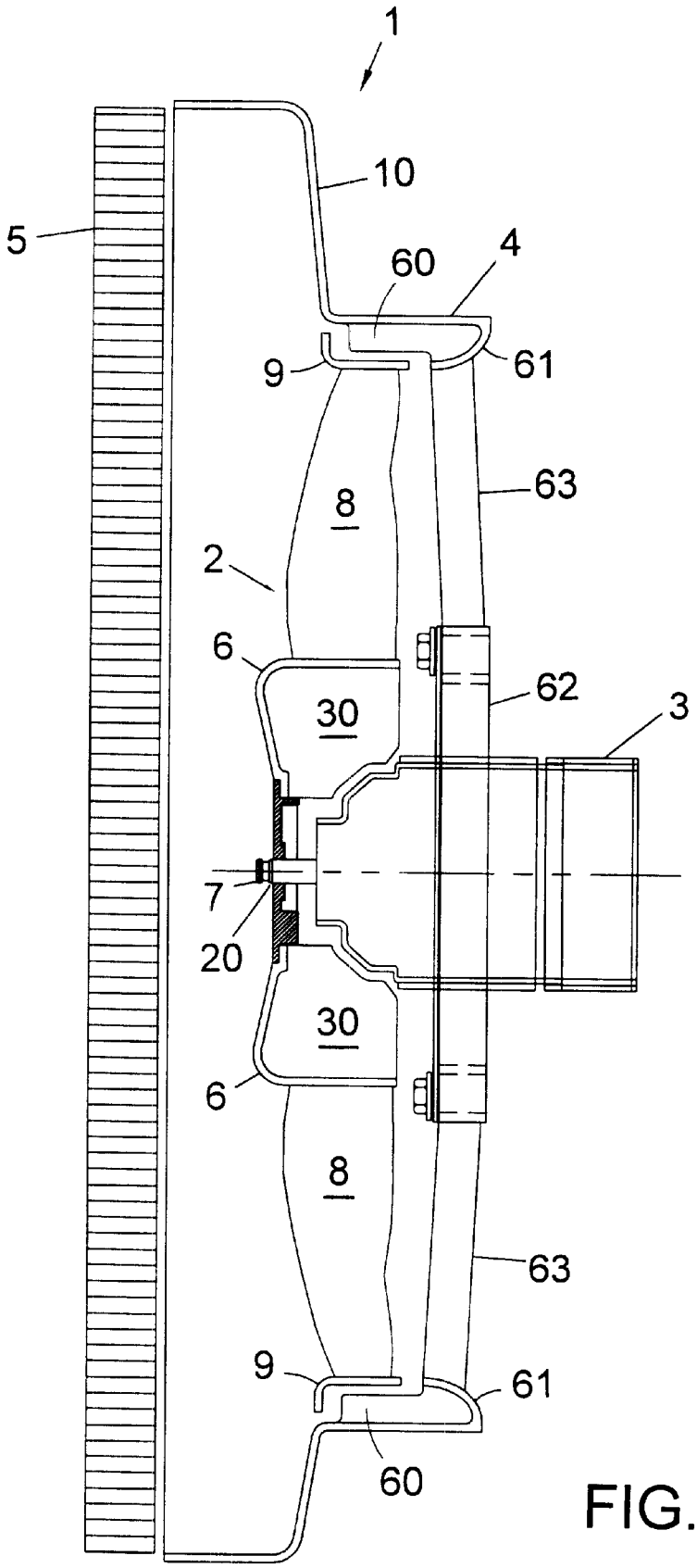
FIG. 6 shows a detailed cross-section of an automotive cooling assembly which comprises a heat exchanger, a shroud with plenum, leakage control device, exit bell mouth, motor mount and support stators, an electric motor, and a banded fan.
Figure 7:
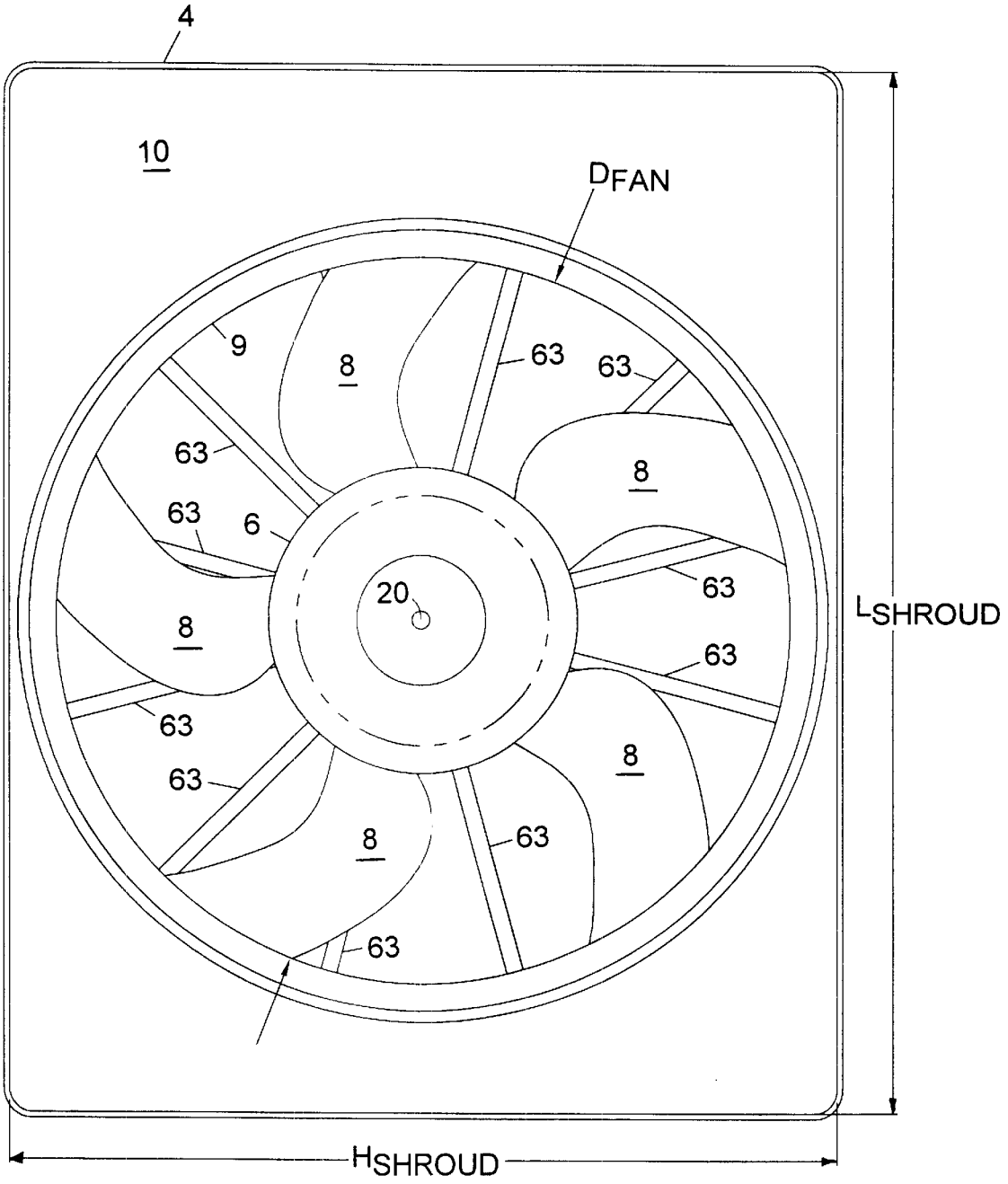
FIG. 7 is a front elevation of a fan having the characteristics described in the present invention, along with a shroud used in a typical automotive cooling assembly.

FIG. 6 shows a cross-section of the fan 2, along with various components of a typical automotive cooling assembly 1, including heat exchanger 5, a shroud 4 with plenum 10, leakage control device 60, exit bell mouth 61, motor mount 62 and support stators 63, and an electric motor 3. FIG. 7 shows a front elevation of the same fan and shroud with the diameter of the fan and the shroud plenum 10 dimensions indicated. The shroud plenum may or may not conform to the dimensions of the vehicle radiator, and is generally, but not necessarily, rectangular in cross-section. The main purpose of the plenum is to act as a funnel, causing the fan to draw air from a large cross-sectional area of the heat exchangers, thereby maximizing the cooling effect of the airflow. The shroud also prevents the recirculation of air from the high-pressure exhaust side of the fan to low-pressure region immediately upstream of the fan.

It has been found that the relative cross-sectional area of the shroud and the fan is a significant factor affecting the inflow to the fan. This factor, or parameter, referred to hereafter as the "area ratio," is calculated for a rectangular shroud as follows:

$$\text{Area Ratio} = \frac{Area_{SHROUD}}{Area_{FAN}} = \frac{L_{SHROUD} \times H_{SHROUD}}{\frac{\pi}{4} D_{FAN}^2}$$

where $L_{SHROUD}$ is the length of the shroud opening where the shroud is attached to the radiator, $H_{SHROUD}$ is the height of the shroud opening where the shroud is attached to the radiator, and $D_{FAN}$ is the fan diameter.

Figure 8:
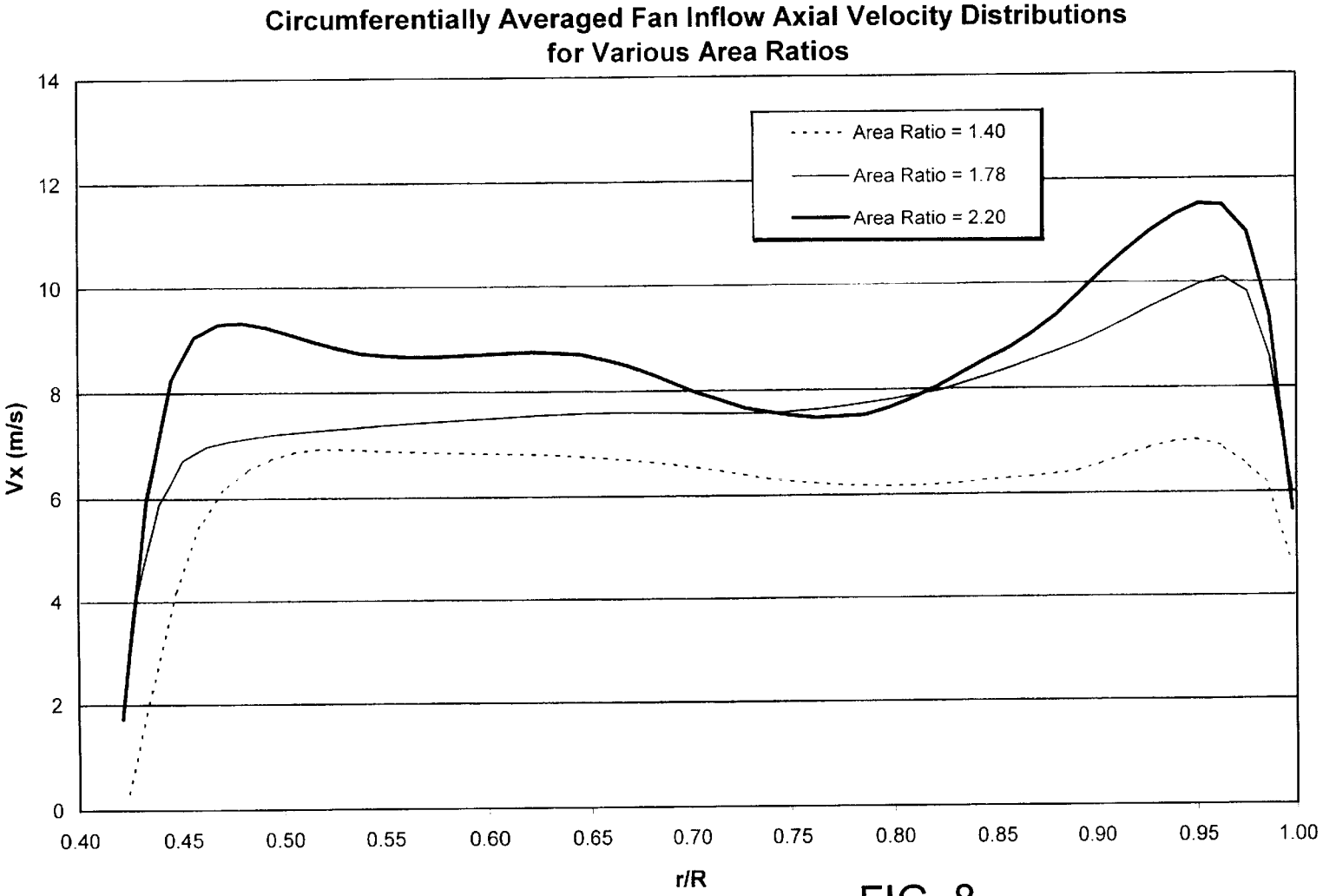
FIG. 8 shows radial distributions of circumferentially averaged axial velocity for fans operating in shrouds with various area ratios.

FIG. 8 shows fan inflow axial velocity distributions (circumferentially averaged), as a function of blade radial location for various area ratios. Note that the theoretical minimum area ratio for a fan operating in a square shroud is $4/\pi$, or approximately 1.27. Whereas a modest area ratio of 1.40 results in almost no radial variation in axial inflow velocity, larger area ratios produce significantly higher axial inflow velocities in a region near the blade tip.

Figure 9A:
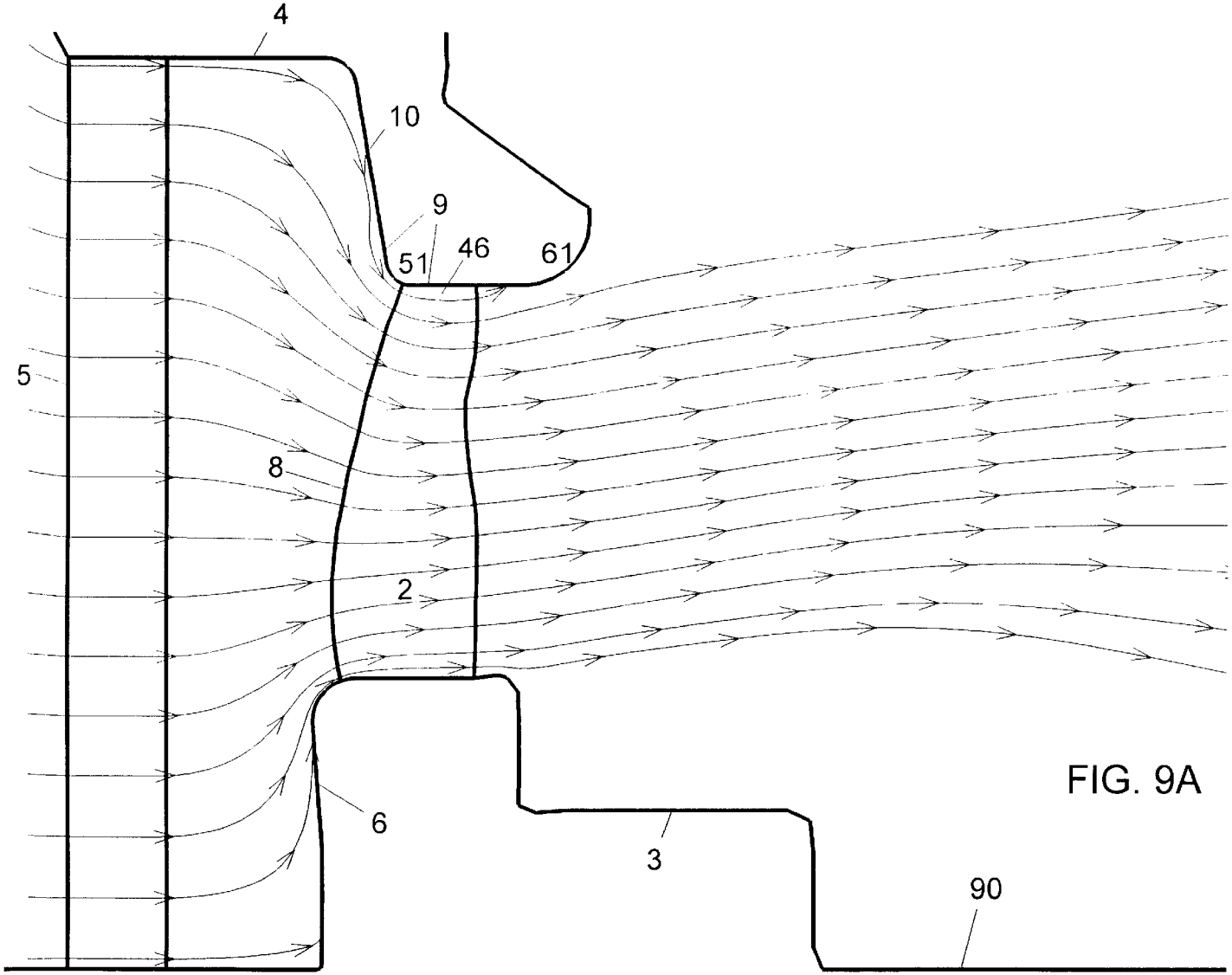
FIG. 9A shows a simplified cross-section of the cooling assembly, including heat exchanger, shroud, motor and fan, including hub. Stream traces indicate the flow of air through the assembly.
Figure 9B:
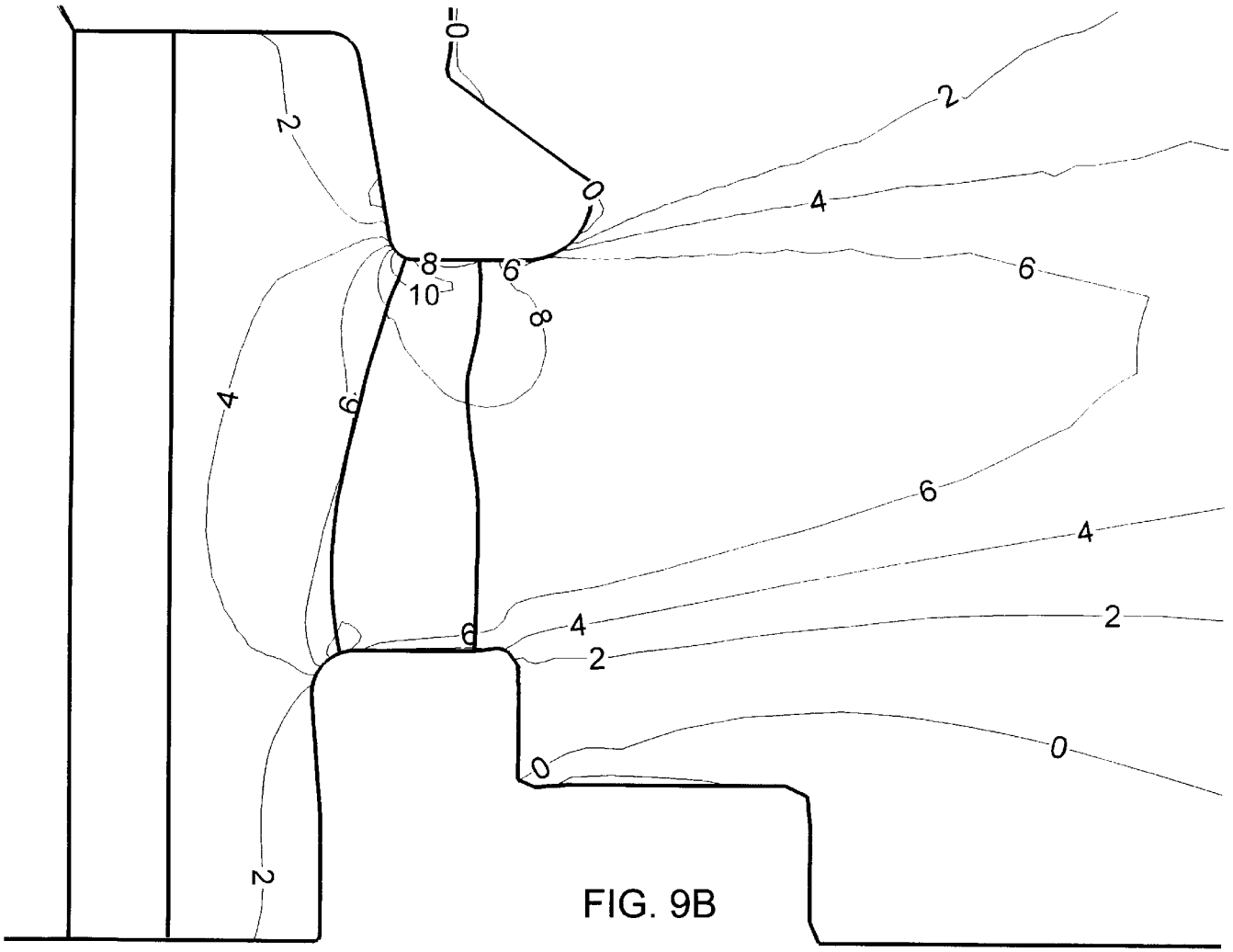
FIG. 9B shows contours of the velocity component parallel to the axis of rotation, demonstrating the concentration of flow that occurs near the tip of the fan blades.

FIG. 9A shows a flow section (½ plane) through the fan axis of rotation 90 of a radiator 5, shroud 4, and fan 2. The area ratio of this shroud-fan combination is 1.78. Streamlines are shown to indicate the manner in which the flow passes through the radiator 5 and fan 2. The air is forced to flow in a direction parallel to the fan axis of rotation 90 (axial direction) by the cooling fins of the radiator 5, before converging rapidly to pass through the fan 2. FIG. 9B shows the same flow section with contours of axial velocity. A region of high flow velocities is clearly visible near the tip 46 of the fan.

This feature of the inflow velocity profile has several causes. First, the flow straightening effect of the heat exchanger cooling fins prevents the incoming airflow at the outer corners of the shroud from converging on the fan opening until after it has passed through the heat exchanger. Consequently, the flow is forced to converge rapidly in the relatively short axial space available between the heat exchanger and the fan. This flow feature is exaggerated by the aerodynamic resistance (pressure drop) of the radiator, which discourages high velocity flow directly in front of the fan and creates a relative increase in the amount of air flowing through the radiator at the outer corners. The flow converging from these outer corners must then turn abruptly at the fan band before passing through the fan. As mentioned previously, the bell mouth radius on the fan band is generally limited to dimensions less than 10–15 mm, so a concentrated jet of faster-moving air develops at the lip of the shroud/fan opening. An important additional factor contributing to the higher velocities at the fan tip region is the variation in head loss through the heat exchanger with radial location. The slower moving air at the outer corners loses less pressure head as it passes through the radiator. The greater residual energy left in the flow at the outer radii results in higher velocities near the tip of the fan.

Also apparent in FIG. 8 and FIG. 9B is a sudden decrease in axial velocity at the radially outermost extreme portion of the fan blade. This is due to friction on the walls and to the rapid pressure recovery downstream of the "jet" flow at the bell mouth 51 of the band. This vena contracta effect causes the bulk of the flow near the tip 46 of the blade to move radially inward as it passes through the fan, creating a region of slower-moving air at the very extreme tip 46 of the blade.

It should be noted that these flow characteristics are also present in the case where a heat exchanger is placed on both the upstream and downstream side of the fan (FIG. 12). Where a heat exchanger is located only on the downstream side of the fan, a concentrated jet of accelerated flow will still occur at the band. however, the strength of the jet will be reduced.

While reducing these radial variations in inflow velocity is possible with a well-designed fan, eliminating them entirely is difficult, particularly for airflow assemblies with large area ratios. It can also be self-defeating, as altering the velocity field at the fan to improve fan efficiency can affect the flow at the heat exchanger in such a way as to increase the resistance of the heat exchanger, thus yielding zero net gain in overall system efficiency. Consequently, the fan designer should expect a non-uniform flow environment when developing a blade design (particularly the blade pitch distribution) for quiet and efficient performance in operation with a shroud and heat exchanger(s).

Figure 10:
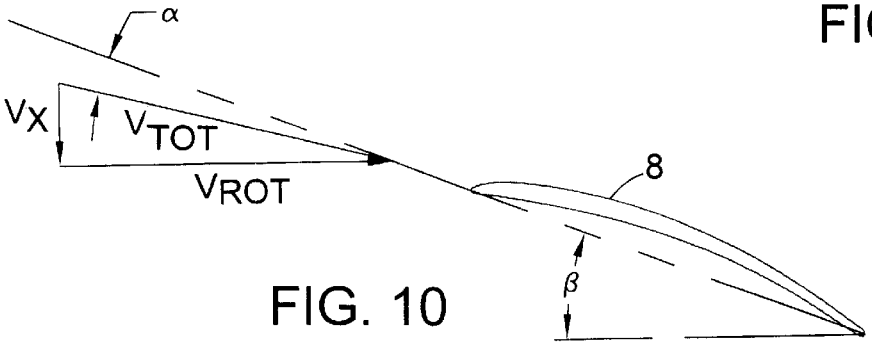
FIG. 10 shows a typical blade cross-section with inflow velocity vectors.

FIG. 10 shows the inflow velocity vector, $V_{TOT}$, relative to the rotating fan blade, at a constant radius blade section, a small distance upstream of the fan. The inflow vector comprises a rotational component, $V_{ROT}$, due to the fan rotation (reduced downstream due to the swirling flow created by the fan) and an axial component, $V_X$, due to the general flow of air through the fan. One can easily infer from FIG. 10 that in regions of higher axial velocity, $V_X$, the pitch angle, $\beta$, should be increased to maintain the desired angle of attack, $\alpha$. Conversely, regions with reduced axial velocity require reduced blade pitch.

Figure 11:
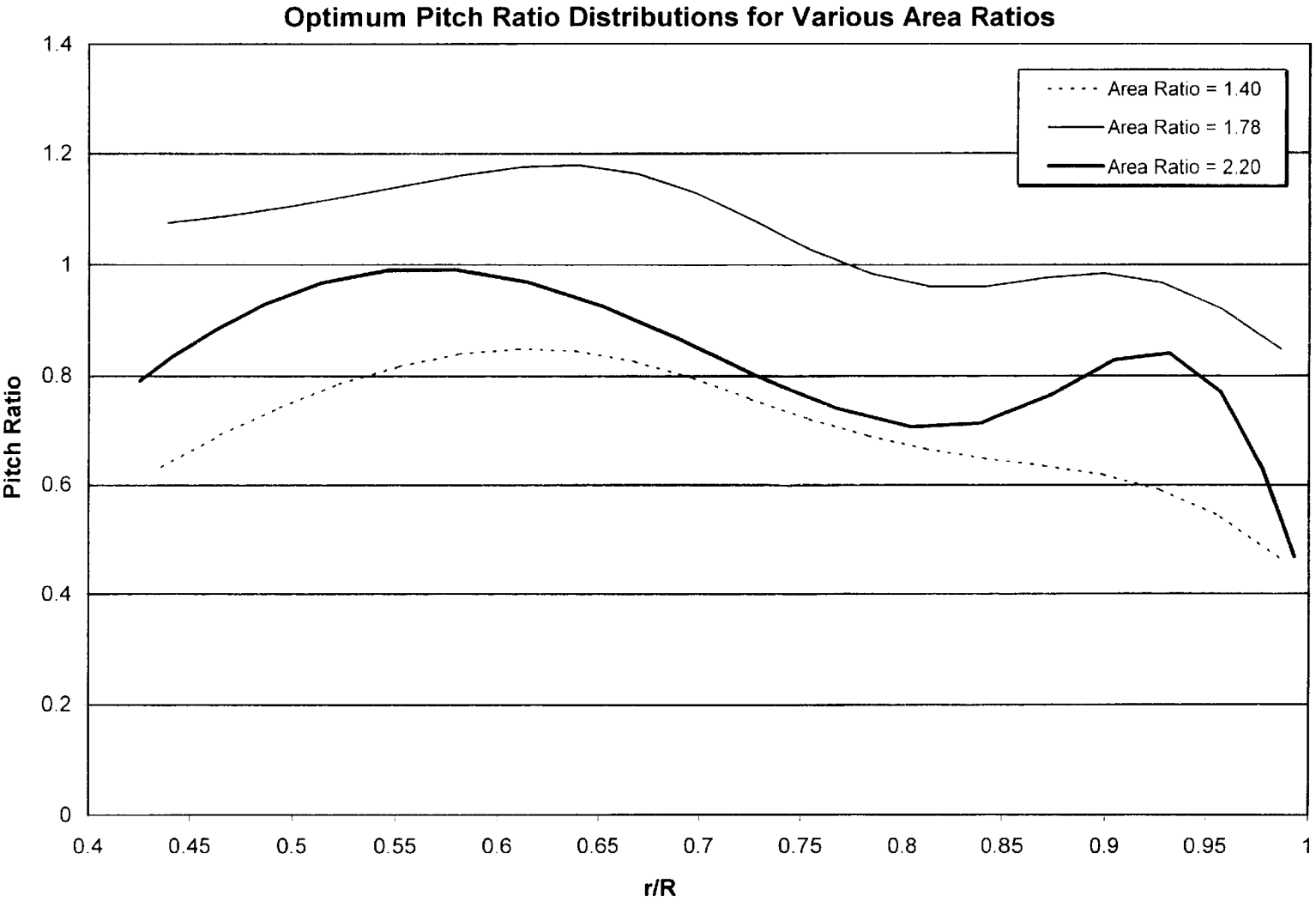
FIG. 11 shows radial distributions of pitch ratio for fans operating in shrouds with various area ratios.

FIG. 11 shows blade non-dimensional pitch ratio distributions corresponding to the inflow velocity distributions shown in FIG. 8. Pitch ratio is defined as the ratio of blade pitch to fan diameter, where pitch is the axial distance theoretically traveled by the blade section through one shaft revolution, if rotating in a solid medium, per a mechanical screw. It can be calculated from the blade pitch angle, $\beta$ (i.e. the angle between the blade section and the plane of rotation) as $\pi \times r/R \times \tan\beta$, but is a more illustrative parameter than pitch angle. For example, ignoring skew and swirl (down wash) effects, a fan operating in a perfectly uniform inflow will have constant pitch ratio across the blade span. Pitch angle, however, will decrease with radius. Thus, pitch ratio is a more direct indicator of the effects of skew, swirl, and non-uniform inflow velocities on the blade design.

All the blade designs in FIG. 11 are back skewed, with similar or identical skew distributions to the fan shown in FIG. 1–3. In some cases, the number of blades, blade chord length, thickness, and camber differ. For the relatively low area ratio of 1.4, the inflow is more or less uniform (FIG. 8) and so skew effects dominate the selection of pitch distribution. As is expected from previous patents, including U.S. Pat. No. 4,569,632, the pitch ratio for the back skewed fan decreases continuously with radius, particularly in the radially outer portion of the blade. However, for larger area ratios, the influence of the inflow velocity distribution becomes significant. The resulting optimum blade pitch distributions show an increase in pitch ratio in the radial region where the axial inflow velocities are increasing, followed by a decrease in pitch ratio in the outermost portion of the blade. This deviates from the pitch distributions for radial and back skewed fans described in previous literature.

A fan according to the present invention features a radial pitch distribution which provides improved efficiency and reduced noise when the fan is operated in a shroud in the non-uniform flow field created by one or more heat exchangers. In the preferred embodiment, the fan blades are radial in planform or swept backwards in the region between the radial location r/R=0.70 and the tip (r/R=1.00). The blades have increasing pitch ratio from the radial location r/R=0.85 to a radial location between r/R=0.90 and r/R=0.975. From this location of local maximum pitch ratio, the pitch ratio decreases to the blade tip (r/R=1.00).

Figure 14:
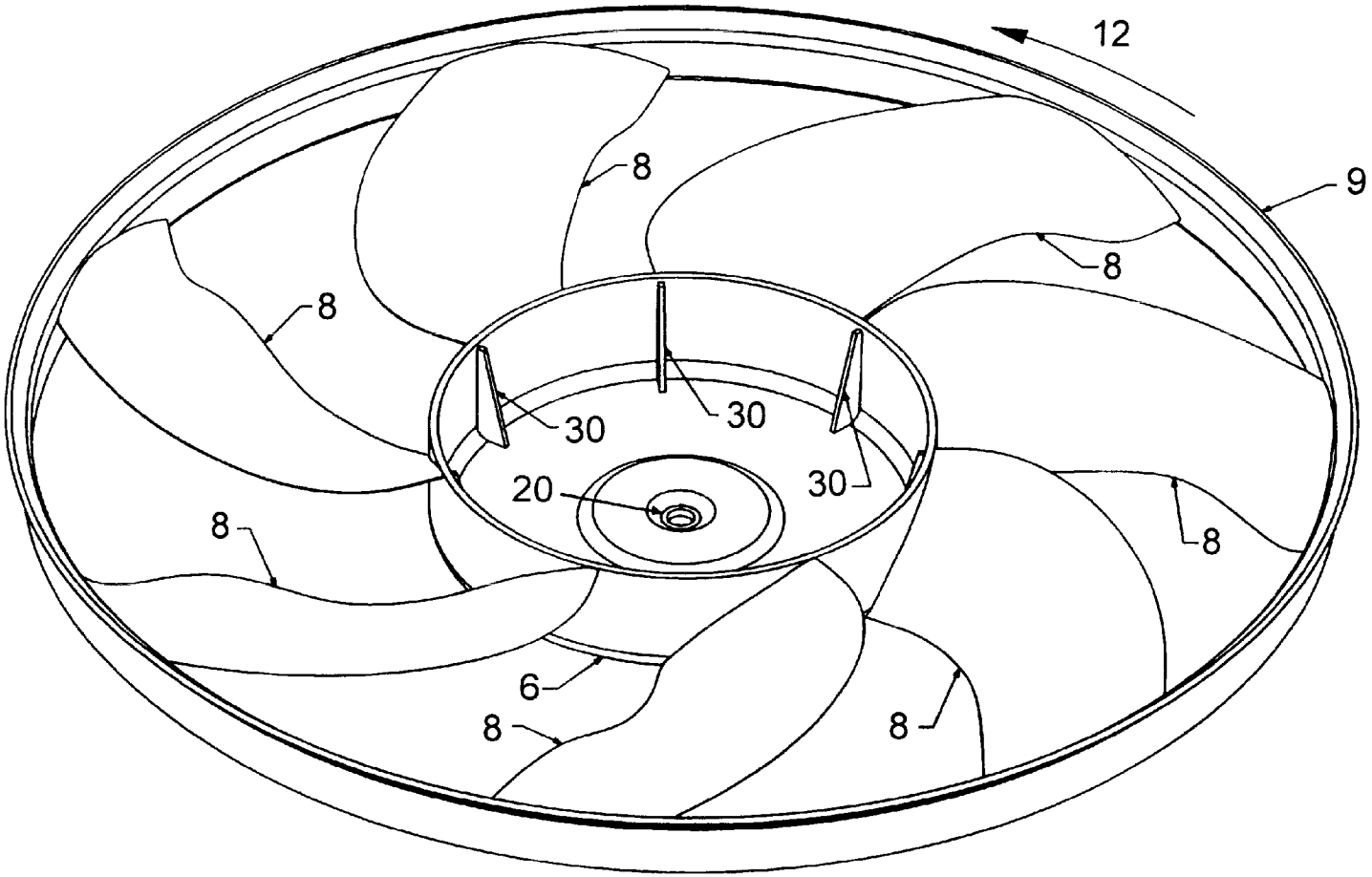
FIG. 14 is a perspective view of a fan with the characteristics described in the present invention.

In a more preferred embodiment (FIG. 14), the fan blades are radial in planform or swept backwards in the region between the radial location r/R=0.70 and the tip (r/R=1.00). The blades have increasing pitch ratio from the radial location r/R=0.85 to a radial location between r/R=0.90 and r/R=0.975. From this location of local maximum pitch ratio, the pitch ratio decreases to the blade tip (r/R=1.00). Furthermore, the local maximum pitch ratio in the region between r/R=0.90 and r/R=0.975 is greater than the minimum pitch ratio value in the region between r/R=0.75 and r/R=0.85 by an amount equal to or greater than 5% of said minimum pitch ratio.

In a still more preferred embodiment (FIG. 14), the fan blades are radial in planform or swept backwards in the region between the radial location r/R=0.70 and the tip (r/R=1.00). The blades have increasing pitch ratio from the radial location r/R=0.825 to a radial location between r/R=0.90 and r/R=0.95. From this location of local maximum pitch ratio, the pitch ratio decreases to the blade tip (r/R=1.00). Furthermore, the local maximum pitch ratio in the region between r/R=0.90 and r/R=0.95 is greater than the minimum pitch ratio value in the region between r/R=0.775 and r/R=0.825 by an amount equal to or greater than 20% of said minimum pitch ratio.

In a most preferred embodiment (FIG. 14), the fan blades are radial in planform or swept backwards in the region between the radial location r/R=0.70 and the tip (r/R=1.00). The blades have increasing pitch ratio from the radial location r/R=0.775 to the radial location r/R=0.925. From the location r/R=0.925, the pitch ratio decreases to the blade tip (r/R=1.00). Furthermore, the pitch ratio at r/R=0.925 is greater than the pitch ratio at r/R=0.775 by an amount equal to or greater than 20% of said minimum pitch ratio.

Maintaining a blade pitch distribution with the above-mentioned preferred characteristics provides for greater efficiency and reduced noise for fans operating in shrouds near heat exchangers such as automotive condensers and radiators A number of embodiments of the invention have been described. Nevertheless, it will be understood that various modifications may be made without departing from the spirit and scope of the invention. The precise nature of the non-uniformity depends on several factors, including radiator and shroud geometry, and can also be influenced by objects downstream of the fan, such as blockage or additional heat exchangers. Optimum radial distribution of blade pitch for quiet and efficient operation will also depend on these factors and will, in general, differ between cooling assemblies of different design. Accordingly, other embodiments are within the scope of the following claims.

What is claimed is:

1. A fan comprising a hub rotatable on an axis, a plurality of airfoil-shaped blades, each of which extends radially outward from a root region attached to said hub to a tip region, a generally circular band connecting the blade tip regions, each of said blades:

(i) in the region between r/R=0.70 and a blade tip (r/R=1.00), either having a generally radial planform or being generally rearwardly swept away from the direction of rotation; and (ii) being oriented at a pitch ratio which:

A. generally increases from a first radial location, at r/R=0.85, to a second radial location, said second radial location being between r/R=0.90 and r/R=0.975 and B. generally decreases from said second radial location to said blade tip.

2. The fan of claim 1 wherein X represents the greatest pitch ratio value in the region between r/R=0.90 and r/R=0.975, inclusive, and Y represents the smallest pitch ratio value in the region between r/R=0.75 and r/R=0.85, inclusive, and $X \geqq 1.05\ Y$.

3. The fan of claim 1 wherein, (i) the pitch ratio generally increases from r/R=0.825 to r/R=0.85, (ii) the second radial location is between r/R=0.9 and r/R=0.95, and (iii) Q represents the greatest pitch ratio value in the region between r/R=0.90 and r/R=0.95, inclusive, and Z represents the smallest pitch ratio value in the region between r/R=0.775 and r/R=0.825, inclusive, and $Q \geqq 1.2\ Z$.

4. The fan of claim 3 wherein the pitch ratio generally increases from r/R=0.775 to r/R=0.85, and the second radial location is at least r/R=0.925.

5. The fan of claim 1 wherein said fan is formed as an integral structure.

6. The fan of claim 1 wherein said integral structure is formed of a molded plastic material.

7. An airflow assembly which creates an axial airflow through at least one heat exchanger, said assembly comprising, (i) a fan according to any of claims 1–6; and (ii) a shroud having a peripheral wall extending from said fan to said heat exchanger to guide the flow of air through said heat exchanger.

8. The airflow assembly of claim 7 wherein said assembly is adapted for connection to a heat exchanger positioned downstream from said fan, and said peripheral wall extends downstream of said fan to provide a discharge for air flowing through said heat exchanger.

9. An airflow assembly according to claim 7 wherein said assembly is adapted for use with an automotive engine cooling heat exchanger.

10. A method of assembling a cooling assembly comprising, (1) providing an airflow assembly according to claim 7, and a heat exchanger, and (ii) assembling said airflow assembly to said heat exchanger.

11. The airflow assembly of claim 7 wherein said assembly is adapted for connection to a heat exchanger positioned upstream from said fan, and said peripheral wall extends upstream of said fan to provide an intake for air flowing from said heat exchanger, said opening being a discharge opening.

12. An airflow assembly according to claim 11 wherein:

(i) the assembly creates an axial airflow through at least one additional heat exchangers located downstream of said assembly;

the shroud has a peripheral wall extending downstream of said fan to provide a discharge for air flowing through said additional heat exchanger.

13. The airflow assembly of claim 7, in which said shroud further comprises a plenum surface to prevent the recirculation of air from the high pressure exhaust side of the fan to the low pressure region immediately upstream of the fan, with an opening of reduced periphery which closely encloses said fan at the outer edge of said band.

14. The airflow assembly of claim 13 further comprising said heat exchanger.

15. A method of assembling an airflow assembly, comprising, providing:

(i) a fan according to any of claims 1–6; and (ii) a shroud having a peripheral wall extending from said fan to said heat exchanger to guide the flow of air through said heat exchanger, said shroud further having a funnel-like plenum surface, to prevent the recirculation of air from the high pressure exhaust side of the fan to the low pressure region immediately upstream of the fan, with an opening of reduced periphery which closely encloses said fan at the outer edge of said band; and assembling said fan and said shroud to produce said airflow assembly.

* * * * *

UNITED STATES PATENT AND TRADEMARK OFFICE

CERTIFICATE OF CORRECTION

PATENT NO. : 6,579,063 B2 
DATED : June 17, 2003
INVENTOR(S) : Robert W. Stairs and David S. Greeley It is certified that error appears in the above-identified patent and that said Letters Patent is hereby corrected as shown below:

Title page,
Item [*] Notice, please amend as follows:
"U.S.C. 154(b) by 0 days" should read -- U.S.C. 154(b) by 28 days --

Signed and Sealed this

Eleventh Day of November, 2003

JAMES E. ROGAN
*Director of the United States Patent and Trademark Office*